US010391809B2

(12) United States Patent
Lambrecht

(10) Patent No.: US 10,391,809 B2
(45) Date of Patent: Aug. 27, 2019

(54) WRITING INSTRUMENT

(71) Applicant: C. Josef Lamy GmbH, Heidelberg (DE)

(72) Inventor: Frank Lambrecht, Rauenberg (DE)

(73) Assignee: C. Josef Lamy GmbH, Heidelberg (DE)

( * ) Notice: Subject to any disclaimer, the term of this patent is extended or adjusted under 35 U.S.C. 154(b) by 0 days.

(21) Appl. No.: 15/424,793

(22) Filed: Feb. 4, 2017

(65) Prior Publication Data

US 2017/0253071 A1 Sep. 7, 2017

(30) Foreign Application Priority Data

Mar. 3, 2016 (DE) ..... 10 2016 002 477

(51) Int. Cl.

| | |
|---|---|
| ***B43K 23/12*** | (2006.01) |
| ***B43K 23/08*** | (2006.01) |
| ***B43K 8/00*** | (2006.01) |
| ***B43K 5/00*** | (2006.01) |
| ***B43K 7/00*** | (2006.01) |

(52) U.S. Cl.

CPC ..... *B43K 23/12* (2013.01); *B43K 5/005* (2013.01); *B43K 7/005* (2013.01); *B43K 8/003* (2013.01); *B43K 23/08* (2013.01)

(58) Field of Classification Search

CPC ..... B43K 23/08; B43K 23/12
USPC ..... 401/244
See application file for complete search history.

(56) References Cited

U.S. PATENT DOCUMENTS 2,192,644 A * 3/1940 La May ..... B43K 23/128 401/244
3,666,373 A 5/1972 Reed
8,540,450 B1 9/2013 Conable
(Continued)

FOREIGN PATENT DOCUMENTS

CN 101022962 A 8/2007
CN 201566286 U 9/2010
CN 104108262 A 10/2014
(Continued)

OTHER PUBLICATIONS

Japan Patent Office, Office Action in related application, dated May 8, 2018.
(Continued)

*Primary Examiner* — Jennifer C Chiang
(74) *Attorney, Agent, or Firm* — Laurence P. Colton; Smith Tempel Blaha LLC

(57) ABSTRACT

A writing instrument having a writing part, having a writing tip, and having a protective cap which protects, the writing tip and is releasably connectable to the writing part. For the releasable connection between the cap and writing part, the writing part has several connecting structures, each with a connecting region which is curved in an ellipsoidal, ball-shaped manner, such as balls or semi-spheres, and the cap has an internal thread on the inside. The internal thread of the cap and the connecting structure of the writing part are positioned and aligned with each other in such a manner that, in each case with the cap in a state fastened on the writing part, the connecting region of the respective connecting structure engages completely or in part in a or the thread of the internal thread.

13 Claims, 2 Drawing Sheets

(56) References Cited

U.S. PATENT DOCUMENTS

2011/0236122 A1 9/2011 Rolion

FOREIGN PATENT DOCUMENTS

Figure 1:
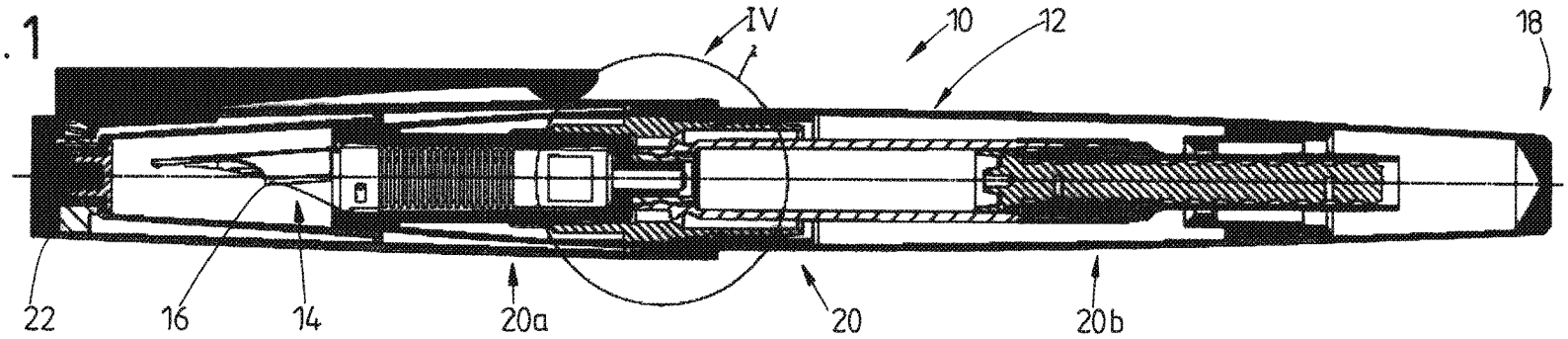

| | | | | |
|---|---|---|---|---|
| DE | 965551 | B1 | | 6/1957 |
| DE | 102005014409 | A1 | | 10/2006 |
| FR | 913696 | A | | 9/1946 |
| GB | 2233610 | A | | 1/1991 |
| JP | S58136373 | U | | 9/1983 |
| JP | H10329487 | A | | 12/1998 |
| JP | 2003154783 | A | * | 5/2003 |
| JP | 2003154785 | A | | 5/2003 |
| JP | 2006056209 | A | | 3/2006 |
| WO | 2013140062 | A1 | | 9/2013 |

OTHER PUBLICATIONS

State Intellectual Property Office of the Peoples Republic of China, Notification of the First Office Action, dated Mar. 13, 2018.
Deutsches Patent—Und Markenamt (German Patent and Trademark Office), Recherchebericht (search in connection with a related application), Mar. 8, 2017.
Korean Intellectual Property Office, Notice of Ground for Preliminary Rejection (n a related application), Nov. 2, 2018.

* cited by examiner

WRITING INSTRUMENT

STATEMENT OF RELATED APPLICATIONS

This patent application claims the benefit of and priority on German Patent Application No. 10 2016 002 477.1 having a filing date of 3 Mar. 2016.

BACKGROUND OF THE INVENTION

Technical Field

The present description relates to a writing instrument having a writing part, which comprises a writing tip, and having a (protective) cap which protects, in particular, the writing tip and is releasably connectable to the writing part.

Prior Art

Different embodiments of writing instruments with a (protective) cap are known. The cap can serve, among other things, for protecting the writing tip from drying out as well as from mechanical influences. At the same time, the most diverse variants exist for fastening the cap to the writing part. Thus, it is known, for example, to place the cap onto the writing part with an oversize such that a frictional locking connection is primarily produced. In addition, solutions are known where the cap comprises a recess for a push button which is mounted in a resilient manner on the writing part. A positive locking connection is primarily brought about as a result. In addition, solutions are known where an external thread is arranged on the writing part, onto which external thread an internal thread, which is arranged on the inside surface of the cap, is screwed.

Both the aforementioned push button and the external thread are found by some users to be bothersome as when writing, the hand of the user potentially contacts the push button or rather the external thread.

BRIEF SUMMARY OF THE INVENTION

The object underlying the present invention is to develop further a writing instrument of the type named in the introduction.

Said object is achieved by a writing instrument having a writing part, which comprises a writing tip, and having a (protective) cap which protects, in particular, the writing tip and is releasably connectable to the writing part, characterized in that for the releasable connection between cap and writing part, the writing part comprises several connecting means, each with a connecting region which is curved in an ellipsoidal, in particular ball-shaped manner, in a preferred manner balls or semi-spheres, and the cap comprises an internal thread on the inside, wherein the internal thread of the cap, on the one hand, and the connecting means of the writing part, on the other hand, are positioned and aligned in such a manner that, in each case with the cap in a state fastened on the writing part, the connecting region of the respective connecting means engages completely or in part in a or the thread of the internal thread.

Accordingly, for the releasable connection between (protective) cap and writing part, the writing part comprises several separate connecting means (spaced apart from one another), each with a connecting region which is curved in an ellipsoidal manner, and the cap comprises an internal thread on the inside, wherein the internal thread of the cap, on the one hand, and the connecting means of the writing part, on the other hand, are positioned and aligned in such a manner that, in each case with the cap in a state fastened on the writing part, the connecting region, which is curved in an ellipsoidal manner, of each connecting means engages in a or the thread of the internal thread. In a preferred manner, the connecting means are balls which, as is well known, provide particular ellipsoids, and which have, correspondingly, a particular connecting region which is curved in an ellipsoidal manner, namely a surface which is curved in a ball-shaped manner. The use of semi-spheres is also conceivable, the ball-shaped curved side of which serving as the connecting region. However, the use of other connecting means with connecting regions which are curved in another correspondingly ellipsoidal manner is also possible.

The cap, in this case, can be rotated or screwed onto the screw part as a result of suitable relative rotation between cap and writing part similarly as in the case of a usual screw connection. In the course of the relative rotation, the connecting means are guided in each case along the thread, the curved connecting region, at the same time, engaging in the thread.

In accordance with the course of the helical curve of the thread of the internal thread of the cap, the connecting means, in particular the curved connecting regions of the same, are preferably arranged along an imaginary helical curve which is matched thereto and is assigned to the writing part.

In this case, the connecting means are each arranged in a preferred manner spaced apart from one another along said imaginary helical curve.

As a result, the connecting regions, which are curved in an ellipsoidal manner, of the connecting means then assume the function of an external thread. The form of the individual connecting regions, which is curved in an ellipsoidal manner or rather is rounded, is found by a user to be very much less bothersome, for instance compared to an external thread with continuous thread flanks. Apart from this, it is possible to use only very few individual connecting means which are spaced apart from one another, for instance two or three. At the same time, the dimensions thereof can be kept small—adapted to the thread of the internal thread. The aesthetic impression of the rounded connecting regions or the connecting regions curved in the shape of an ellipsoid is also positive. In particular, when the connecting means are balls or semi-spheres.

The connecting means can be arranged or rather mounted on the writing part, for example in a stationary and rotatable manner. Said rotatable bearing arrangement involves particular advantages. Thus, even when the writing instrument is in frequent use or the cap is frequently fastened to and released from the writing part, no partial wear occurs on said cap on account of the rotation of the connecting means. This applies not only but in particular to the use of balls. In this case, wear is distributed in a uniform manner over all of the respective ball. The fastening operation or rather the screwing and unscrewing of the cap is also made easier as the balls are able to roll in the meantime in their position.

As an alternative to the stationary and rotatable bearing arrangement, however, it is also conceivable to fasten the connecting means on the writing part or rather to mount them there in a stationary and non-rotatable manner. In particular when using semi-spheres, a non-rotatable and stationary arrangement is to be preferred. However, balls or other connecting means which have a connecting region which is curved in the manner of an ellipsoid could just as well also be arranged or rather mounted in this way.

In a further realization of the invention, the balls can be situated in each case in a recess or an indentation of the writing part, in particular in a recess or indentation arranged on the outside of the writing part.

In this case, the connecting means are preferably arranged in a region of the writing part where the writing part is usually gripped by a user during a writing operation.

As regards the cap, at one end it comprises in a preferred manner an opening into which the writing part can be slid for fastening the cap on the writing part. The internal thread, in this case, is arranged adjacent the cap opening on the inside surface of the cap, in particular no further away from the cap opening than ⅓.

As regards the connecting means, in an expedient manner they protrude radially in each case, at least in regions, in relation to the outside surface of the writing part, which is covered by the cap when the cap is in the fastened state.

In this case, each connecting region, with reference to a cross section, which incorporates the same, through the writing part is arranged, at least in regions, further outside radially than the contour line of the writing part. This applies in particular to the curved connecting region of the respective connecting means.

In a further realization of the invention, the writing part can comprise a holding ring which extends in the circumferential direction and has indentations or recesses for the connecting means, wherein one connecting means in each case is situated in each indentation or recess.

In this case, the holding ring can be covered on the outside radially by a cover ring which comprises, for each connecting means, a radially extending opening, through which the respective connecting means, which is situated in the indentation or recess, extends at least in regions to the outside.

In addition, it is expedient when the outside surface of the holding ring or of the cover ring extends in a flush manner with respect to outside surfaces of adjoining outside walls of the writing part which adjoin the holding ring or rather the cover ring on both sides of the holding ring or rather of the cover ring.

BREIF DESCRIPTION OF THE DRAWINGS

Figure 2:
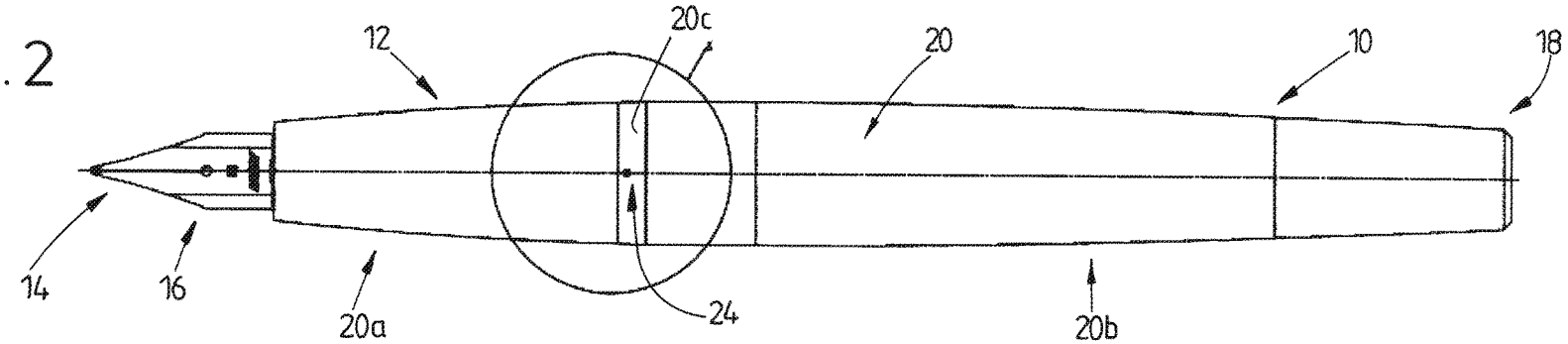
Figure 3:
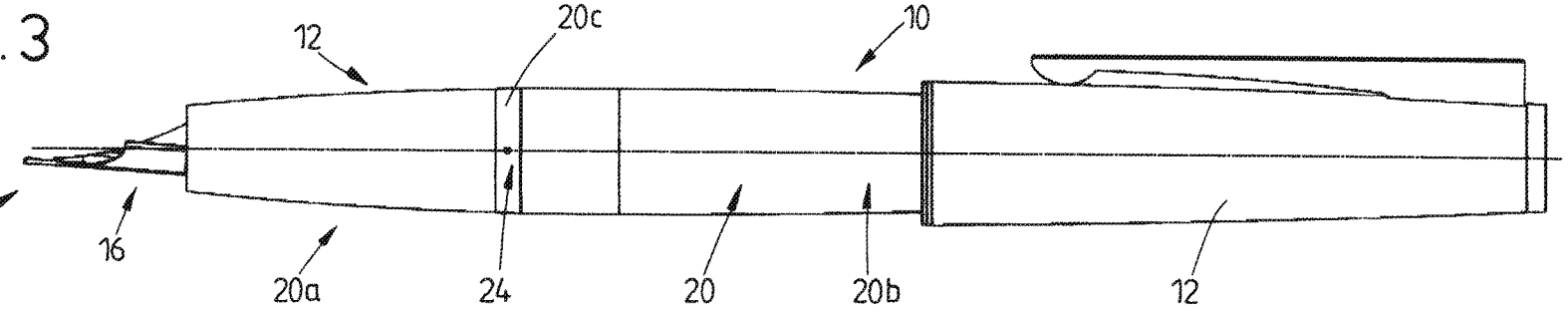
Figure 4:
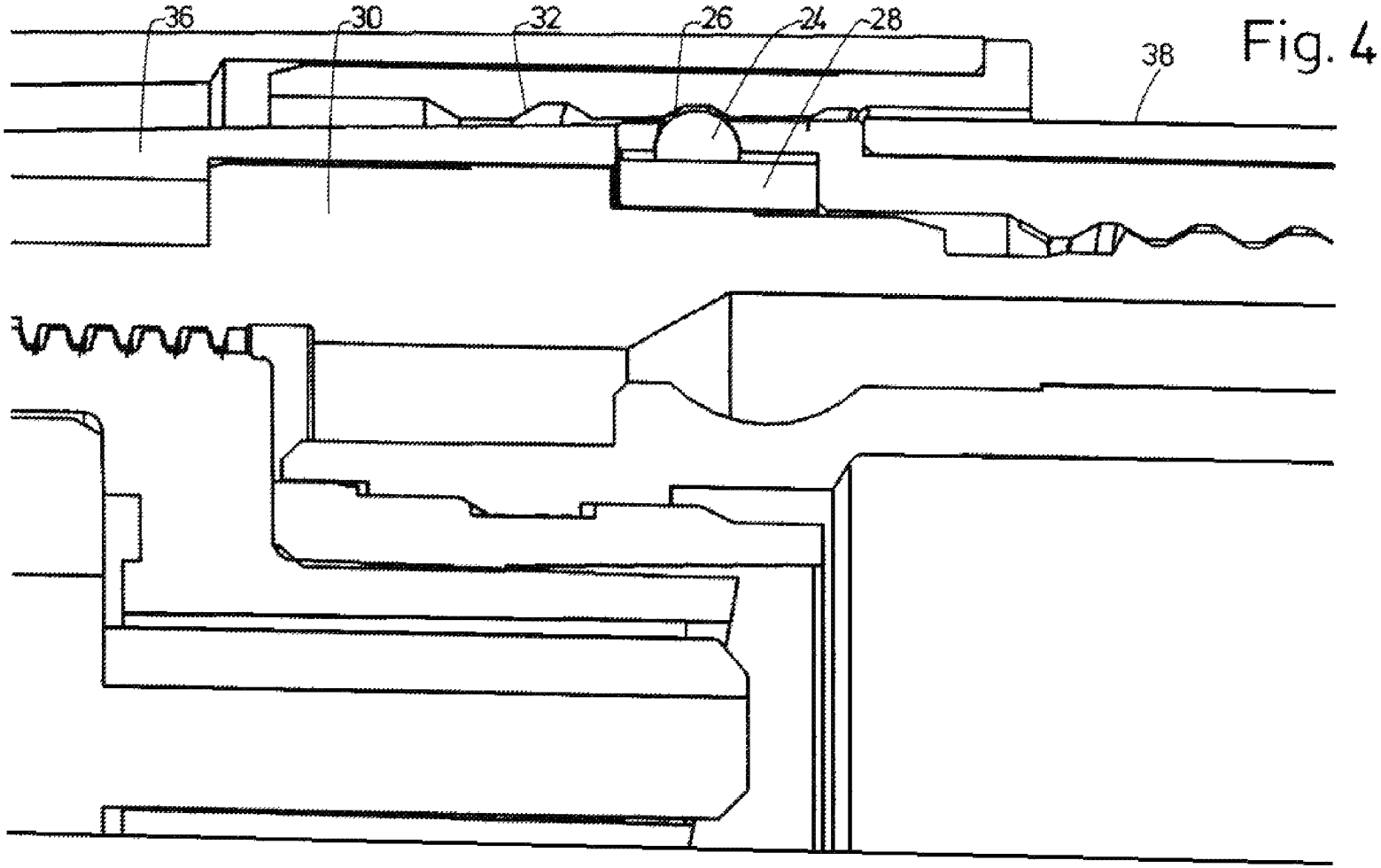

Further features of the invention are produced from the accompanying claims, the following description of a preferred exemplary embodiment and from the accompanying drawings, in which:

FIG. 1 shows a longitudinal section through an embodiment of a writing instrument according to the invention, FIG. 2 shows a first side view of the writing instrument from FIG. 1, FIG. 3 shows a side view of the writing instrument from FIG. 2, rotated by 90° in relation to the representation in FIG. 2, and FIG. 4 shows an enlarged representation of a detail IV from FIG. 1.

DETAILED DESCRIPTION OF PREFERRED EMBODIMENTS

The invention is explained by way of a writing instrument 10 which is realized as a fountain pen. However, the invention is in no way restricted to fountain pens. It can also be used in conjunction with other writing instruments which comprise a writing tip, such as ballpoint pens, rollerball pens, etc.

The writing instrument 10 comprises a writing part 12 with a first (front) end 14 with an assigned writing tip 16, in the present case a nib, and a second oppositely situated (rear) end 18.

The writing part 12 has a (multi-part) housing 20 with a first (front) housing part 20*a*, to which the writing tip 16 is assigned, a second (rear) housing part 20*b* as well as a housing ring part 20*c* which is arranged between said housing parts. The first housing part 20*a* and the second housing part 20*b* are realized in a sleeve-like manner in the present exemplary embodiment. At the same time the first housing part 20*a* forms a gripping part, where the writing part 12 is regularly gripped by a user during a writing operation. The multi-part housing design described here is not a mandatory component part of the present invention.

In the interior of the housing 20, the writing part has components which are known per se and are consequently not described in any more detail in the present case, such as, for example, an ink reservoir, for instance in the form of an ink cartridge, and one or more ink feed channels, by means of which ink is fed from the ink reservoir to the nib.

Along with the writing part 12, the writing instrument 10 additionally comprises a protective cap 22 which serves for the protection of the writing tip 16, which is arranged permanently outside the housing 20 in the present exemplary embodiment. The invention, however, is not limited to writing instruments with writing tips which are arranged permanently outside the housing of the writing part. It can also be used in conjunction with writing instruments where the writing tip is only extendible out of a housing or rather is retractable into said housing on demand.

In the present case, the protective cap 22 is also realized in a sleeve-like manner with an open end into which the writing tip 16 is able to be inserted for the protection of the same.

The protective cap 22 can be fastened in a releasable manner on the writing part 12 with the writing tip 16 in the state inserted in the protective cap 22. The fastened state of the protective cap 22 is shown in FIGS. 1, 4.

The connection between protective cap 22 and writing part 12 is effected in a particular manner. For this purpose, the writing part 12 comprises several connecting means 24, each with a connecting region 26 which is curved in an ellipsoidal manner. In the present example, the connecting means 24 are balls with a correspondingly ball-shaped surface or rather a ball-shaped connecting region 26. However, other connecting means with a different ellipsoidal connecting region can be used.

In the present case, the connecting means 24 are mounted in a stationary manner relative to the housing 20 such that translation movements in the radial or axial direction are not possible.

However, at the same time they are mounted so as to be pivotable or rotatable such that rotational movements are possible at the mounting site (in particular about their own axis (axes) of symmetry).

In the present case, the bearing arrangement is effected on a holding ring part 28 which extends in the circumferential direction. However, this is not compulsory. The holding ring 28 could also be dispensed with and the connecting means 24 mounted, for example, directly in/on the wall of the housing 20, in particular of the first housing part 20*a*.

The holding ring 28, in turn, is fixedly connected to an inside part 30 of the writing part 12 which is mounted in the housing 20 and is stationary relative to said housing.

With the protective cap 22 in the fastened state shown in FIGS. 1, 4, the connecting means 24 engage in an internal thread 32, which is arranged on the inside in the region of the open end of the protective cap 22. Specifically, the respective connecting region 26, which is curved in an ellipsoidal manner, of the respective connecting means 24 engages in the thread 34 of the internal thread 32 or rather in each case in a corresponding part portion thereof.

For this purpose, the internal thread 32 has a thread 34 which is arranged in the usual manner along an imaginary helical curve.

The connecting means 24 are also arranged along an imaginary helical curve on the writing part 12, matched to said thread 34, namely in the present case on the holding ring part 28. In this case, the imaginary helical curve of the writing part 12 extends in accordance with the course of the helical curve of the thread 34 of the internal thread 32.

It can be seen in FIGS. 1-4 that, in each case, two adjacent connecting means 24 are not arranged, in each case, on the same circular line in a corresponding manner along the holding ring part 28 in the circumferential direction, but, in each case, are offset in the axial direction or rather are at an axial spacing in relation to one another, and that they are arranged at a specific angular spacing in the corresponding circumferential direction.

Four separate connecting means 24, which are arranged spaced apart from one another in this way, are provided in the present exemplary embodiment. There can naturally also be more or fewer. In the present case, two adjacent connecting means are each arranged in each case at an angular spacing of approximately 90° in the circumferential direction. It is obvious that other angular spacings are also conceivable.

The connecting means 24 are situated, in this case, in a rotatably mounted manner in suitable indentations or recesses of the holding ring part 28. The indentations/recesses are also arranged correspondingly—as the connecting means 24—in each case offset in the axial direction or rather at an axial spacing to one another, and are at a corresponding angular spacing in the circumferential direction.

As can be seen further, the connecting means 24 are arranged such that the connecting regions 26 of the connecting means 24 are arranged in each case further outside radially than the contour line of the writing part 12 in the region of the first housing part 20*a*.

In the present case, the respective connecting region 26 is arranged further outside radially than the adjacent walls 36, 38 of the first housing part 20*a* or rather of the second housing part 20*b*.

As can be seen further, the holding ring part 28 is covered outside radially by the housing ring part 20*c*. The housing ring part 20*c*, in this case, forms a cover ring. At the places where the connecting means 24 are situated, said holding ring part has corresponding openings such that, in regions, the connecting means 24 extend radially to the outside through the housing ring part 20*c*, in particular the respective connecting regions 26 of the connecting means 24.

The outside surface of the holding ring 28 extends, in this case, in a flush manner with respect to the outside surfaces of the walls 36 or rather 38 of the first housing part 20*a* or rather of the second housing part 20*b*.

The state with the protective cap 22 fastened shown in FIG. 1 is otherwise achieved by the protective cap 22, by way of its internal thread 32, being rotated or screwed onto the writing part 12 as a result of a relative movement between protective cap 22 and writing part 12. The connecting means 24 basically assume the function of an external thread, onto which the protective cap 22 or rather the internal thread 32 of the same can be screwed. The protective cap 22 is able to be removed again as required as a result of a corresponding relative movement in the opposite direction.

LIST OF REFERENCES

10 Writing instrument
12 Writing part
14 (Front) end
16 Writing tip
18 (Rear) end
20 Housing
20*a* (Front) housing part
20*b* (Rear) housing part
20*c* Housing ring part
22 Protective cap
24 Connecting means
26 Connecting region
28 Holding ring part
30 Inside part
32 Internal thread
34 Thread
36 Wall
38 Wall

What is claimed is:

1. A writing instrument comprising:

a writing part (12), which comprises a writing tip (16); and a cap (22) which protects the writing tip (16) and is releasably connectable to the writing part (12), wherein, for the releasable connection between the cap (22) and the writing part (12):

the writing part comprises several connecting means (24), each with a connecting region (26) which is curved in an ellipsoidal manner; and the cap (22) comprises an internal thread (32) on the inside, wherein the internal thread (32) of the cap (22), on the one hand, and the connecting means (24) of the writing part (12), on the other hand, are positioned and aligned in such a manner that, in each case with the cap (22) in a state fastened on the writing part (12), the connecting region (26) of the respective connecting means (24) engages completely or in part in a thread (34) of the internal thread (32), wherein the connecting means (24) are arranged in a stationary and rotatable manner relative to the writing part (12), and wherein the cap (22) is transferrable from a state not fastened to the writing part (12) into the state fastened to the writing part (12) as a result of a relative rotation between the cap (22) and the writing part (12), in the course of which the connecting means (24) are guided in each case along and in engagement with the thread (34).

2. The writing instrument according to claim 1, wherein the connecting means (24) are situated in each case in a recess or an indentation of the writing part (12).

3. The writing instrument according to claim 2, wherein the recess or the indentation of the writing part (12) is arranged on the outside of the writing part (12).

4. The writing instrument according to claim 1, wherein the connecting means (24) are arranged in a region of the writing part (12) where the writing part (12) is usually gripped by a user during a writing operation.

5. The writing instrument according to claim 1, wherein one end the cap (22) comprises an opening into which the writing part (12) can be slid for fastening the cap (22) on the writing part (12), and wherein the internal thread (32) is arranged adjacent the cap opening on an inside surface of the cap (22).

6. The writing instrument according to claim 5, wherein the internal thread (32) is arranged no further away from the cap opening than ⅓ the length of the inside surface of the cap (22) from the cap opening.

7. The writing instrument according to claim 1, wherein, in accordance with a course of an imaginary helical curve of the thread (34) of the internal thread (32), the connecting means (24) are arranged along an imaginary helical curve which is matched to the imaginary helical curve of the thread (34) and is assigned to the writing part (12).

8. The writing instrument according to claim 7, wherein the connecting means (24) are spaced apart from one another along the imaginary helical curves.

9. The writing instrument according to claim 1, wherein the connecting means (24) protrude radially in each case, at least in regions, in relation to the outside surface of the writing part (12), which is covered by the cap (22) when the cap (22) is in the fastened state.

10. The writing instrument according to claim 1, wherein each of the connecting means (24), in a cross section through the writing part (12), is arranged, at least in regions, further outside radially than a contour line of the writing part (12).

11. The writing instrument according to claim 1, wherein the writing part (12) further comprises a holding ring (28) which extends in the circumferential direction and has indentations or recesses for the connecting means (24), wherein one connecting means (24) in each case is situated in each indentation or recess.

12. The writing instrument according to claim 11, wherein the holding ring (28) is covered on the outside radially by a cover ring (20*c*) which comprises, for each connecting means (24), a radially extending opening, through which the respective connecting means (24), which is situated in the indentation or recess, extends at least in regions to the outside.

13. The writing instrument according to claim 12, wherein the outside surface of the holding ring (28) or of the cover ring (20*c*) extends in a flush manner with respect to outside surfaces of adjoining outside walls (36, 38) of the writing part (12) which adjoin the holding ring (28) or the cover ring (20*c*) on both sides of the holding ring (28) or of the cover ring (20*c*).

* * * * *